US012590753B2

(12) United States Patent
Feng et al.

(10) Patent No.: US 12,590,753 B2
(45) Date of Patent: Mar. 31, 2026

(54) REFRIGERATION APPLIANCE

(71) Applicant: BSH Hausgeräte GmbH, Munich (DE)

(72) Inventors: Han Feng, Nanjing (CN); Ping Lv, Nanjing (CN); Chun Hu, Nanjing (CN); Chuanxin Wang, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 137 days.

(21) Appl. No.: 18/539,588

(22) Filed: Dec. 14, 2023

(65) Prior Publication Data

US 2024/0200854 A1 Jun. 20, 2024

(30) Foreign Application Priority Data

Dec. 16, 2022 (CN) ..... 202211625649.3

(51) Int. Cl.
*F25D 23/02* (2006.01)

(52) U.S. Cl.
CPC ..... *F25D 23/028* (2013.01); *F25D 23/025* (2013.01); *F25D 2323/023* (2013.01); *F25D 2323/024* (2013.01); *F25D 2400/40* (2013.01)

(58) Field of Classification Search
None
See application file for complete search history.

(56) References Cited

U.S. PATENT DOCUMENTS

| | | | | |
|---|---|---|---|---|
| 9,429,356 | B2 * | 8/2016 | Kim | F25D 23/028 |
| 10,342,363 | B2 * | 7/2019 | Park | A47F 3/0434 |
| 10,465,969 | B2 * | 11/2019 | Lv | F25D 23/028 |
| 10,524,586 | B2 * | 1/2020 | Oh | F25D 23/028 |
| 10,544,983 | B2 * | 1/2020 | Lee | F25D 23/028 |
| 2005/0284159 | A1 * | 12/2005 | Kim | F25D 23/028 62/298 |
| 2006/0064846 | A1 * | 3/2006 | Espindola | E05D 7/081 16/223 |
| 2022/0003028 | A1 * | 1/2022 | Chen | F25D 23/025 |

FOREIGN PATENT DOCUMENTS

| | | | | |
|---|---|---|---|---|
| CN | 110736280 | A * | 1/2020 | F25D 11/00 |
| EP | 3343149 | A1 * | 7/2018 | F25D 23/028 |
| EP | 3617623 | A1 * | 3/2020 | E05F 15/619 |
| WO | WO-2018128377 | A1 * | 7/2018 | F25D 23/028 |

* cited by examiner

*Primary Examiner* — Hanh V Tran
(74) *Attorney, Agent, or Firm* — Laurence A. Greenberg; Werner H. Stemer; Ralph E. Locher

(57) ABSTRACT

A refrigeration appliance includes: a body, where the body is configured to define at least one storage compartment; a first door connected to the body through a first hinge, where the first door is configured to open to enable access and close to inhibit access to one of the at least one storage compartment; and a second door connected to a front of the first door through a second hinge. The refrigeration appliance further includes a connection accommodating portion. A first wire harness located in the first door and a second wire harness located in the second door are electrically connected to each other in the connection accommodating portion. The connection accommodating portion is located on the second hinge. Ideally, a structural layout on the first door can be optimized.

16 Claims, 10 Drawing Sheets

REFRIGERATION APPLIANCE

CROSS-REFERENCE TO RELATED APPLICATION

This application claims the priority, under 35 U.S.C. § 119, of Chinese Patent Application CN 202211625649.3, filed Dec. 16, 2022; the prior application is herewith incorporated by reference in its entirety.

FIELD AND BACKGROUND OF THE INVENTION

Embodiments of the present invention relate to the technical field of refrigeration appliances, and in particular, to a refrigeration appliance.

In a current refrigeration appliance market, there are few door-on-door refrigeration appliance products, and most refrigeration appliance products employ mechanical locking. An outer door does not need to be powered on and therefore does not need to be connected through a wire harness. In consideration of factors such as a product appearance and use convenience, some current door-on-door refrigeration appliance products have electrical components such as a light strip or an electronic lock switch arranged on an outer door. In this case, a wire harness needs to be extended from a body and connected to the outer door from an inside door of the door-on-door (also known as an inner door) through a hinge located at a top or a bottom of the door.

A common design for the door-on-door refrigeration appliance products whose outer door requires electricity is to reserve a connection accommodating portion at the top of the inner door and complete electrical connection of wire harnesses of the inner door and the outer door in the accommodating portion. The design of wire harness connection at the top of the inner door occupies a space of the inner door and effect arrangement of other structures on the inner door.

SUMMARY OF THE INVENTION

Embodiments of the present invention are intended to provide an improved refrigeration appliance.

An embodiment of the present invention provides a refrigeration appliance, including: a body, where the body is configured to define at least one storage compartment. A first door is connected to the body through a first hinge, where the first door is configured to open to enable access and close to inhibit access to one of the at least one storage compartment. A second door is connected to a front of the first door through a second hinge. The refrigeration appliance further includes a connection accommodating portion. A first wire harness located in the first door and a second wire harness located in the second door are electrically connected to each other in the connection accommodating portion. The connection accommodating portion is located on the second hinge.

In this solution, through integration of the connection accommodating portion into the second hinge, an upper end of the first door may be more intact, thereby facilitating manufacturing of the first door.

This solution further facilitates a layout at a top of the first door. In particular, this solution facilitates arrangement of a detection unit, a sensing unit, operating unit, or a control unit at the top of the first door. In this way, the arrangement of the detection unit, the sensing unit, the operating unit, or the control unit at the top of the first door is less likely to be limited by the connection accommodating portion. For example, the detection unit, the sensing unit, the operating unit, or the control unit may be arranged closer to the first hinge.

Optionally, the connection accommodating portion is at least partially located outside a projection range of the first door in a height direction of the refrigeration appliance. The connection accommodating portion or at least part of the connection accommodating portion is removed out of the first door, so that more space may be spared on the first door for other components, thereby optimizing a structural layout on the first door.

Optionally, the connection accommodating portion is located outside a projection range of the first door in a height direction of the refrigeration appliance. In this way, the connection accommodating portion does not occupy any space of the first door, so that the upper end of the first door is more intact, and more space may be provided for other components. Therefore, a layout of the other components arranged at the top of the first door is less likely to be limited. The other components may be, for example, a detection component configured to detect an opening/closing state of the first door and/or the second door, a humidity sensor or a temperature sensor, a user interface module (UIM for short), or a light component.

Optionally, the connection accommodating portion is at least partially located within a projection range of the second door in a height direction of the refrigeration appliance. The connection accommodating portion or a part of the connection accommodating portion is transferred to the second door, that is, the connection accommodating portion is arranged on an outer door, so that an increase in a size of the refrigeration appliance in the width direction is avoided when the connection accommodating portion is removed out of an inner door.

Optionally, the second door includes a receiving portion configured to receive the part of the connection accommodating portion located outside the projection range of the first door in the height direction of the refrigeration appliance. In this way, an increase in the size of the refrigeration appliance in the width direction is avoided when the connection accommodating portion is removed out of the inner door.

Optionally, the refrigeration appliance further includes a top unit located at a top of the first door. The top unit is configured to detect, operate, or control the refrigeration appliance. The first door has a first side and a second side opposite to each other in a width direction. The first hinge is located on the first side. The top unit is closer to the first side than to the second side. Through the arrangement of the connection accommodating portion on the second hinge, more space on the upper end of the first door, especially near the first hinge may be released to the top unit. In this way, the top unit may be arranged more flexibly, for example, may be arranged as close as possible to the first hinge.

Optionally, the refrigeration appliance further includes a first detector arranged on one of the body and the first door and a first magnetic body arranged on the other of the body and the first door. The first detector is configured to cooperate with the first magnetic body to detect whether the first door is opened relative to the body. The first door has a first side and a second side opposite to each other in a width direction. The first hinge is located on the first side. The first magnetic body or the first detector arranged on the first door is arranged closer to the first side than to the second side.

An advantage of the above arrangement is as follows: The first detector or the first magnetic body arranged in the body may be correspondingly arranged at a position in the body close to the first hinge, and in particular, may be accommodated in a first hinge cover and covered by the first hinge cover. In this way, an accommodating casing for the first detector or the first magnetic body on the body may be omitted, thereby optimizing manufacturing and assembly of the refrigeration appliance.

Optionally, the refrigeration appliance further includes a second detector arranged on the first door and a second magnetic body arranged on the second door. The second detector is configured to cooperate with the second magnetic body to detect whether the second door is opened relative to the first door. The second detector is arranged closer to the first side than to the second side.

A beneficial effect of the arrangement is as follows: The wire harness extending from the body may be electrically connected to the second detector by only a short distance after entering the first door through the first hinge. This facilitates cost saving and reduces wiring complexity inside the first door. In addition, the number of electrical components on the second door and the number of cables that need to extend through the second hinge are reduced.

Optionally, the refrigeration appliance further includes a first hinge cover configured to cover the first hinge and the first magnetic body or the first detector arranged on the body. Through the arrangement of the connection accommodating portion outside the first door, a space may be spared on the first door for arranging the first detector or the first magnetic body as close as possible to the first hinge. In this way, the first hinge cover may cover the first magnetic body or the first detector arranged on the body, thereby optimizing a top appearance of the refrigeration appliance.

Optionally, the first door includes a first mounting portion configured to mount the first hinge and a second mounting portion configured to mount the second hinge. The first door includes a wire harness hole facing the second mounting portion. The wire harness hole is configured for the first wire harness located inside the first door to extend to or be electrically connected to outside of the first door. The second hinge further includes a relief portion facing the body for avoiding the part of the first wire harness extending out through the wire harness hole. Due to the outward movement of the connection accommodating portion, the first wire harness needs to extend out of the first door to achieve electrical connection to the second wire harness in the connection accommodating portion. Therefore, if a production process of first assembling the inner door first and then assembling the outer door is adopted, the extended wire harness of the inner door interferes with a movement trajectory of an upper hinge, and hinders pushing of the outer door with the upper hinge into a hinge mounting position. Therefore, prior to the filling date of the present invention, during assembly of the refrigeration appliance, a manufacturer usually assembles the inner door and the outer door together through DonD upper and lower hinges and latches, and then mounts the entire door body to the body through hinges on the door and the body. An overall weight of the pre-assembled door body exceeds 25 kilograms (KG). During transport and mounting of the door body to the body by production line employees, ergonomic risks may be increased as a result of the excessive weight of the door body that does not comply with the ergonomics. The excessive weight of the door body may further increase labor intensity of the employees during the assembly of the door, which easily causes work-related accidents and requires more time to flip and transport the door body. Obviously, in the existing refrigeration appliance, the assembly manner of the door body is limited as a result of interference between the hinge movement trajectory and the extended wire harness of the inner door.

In this implementation, during assembly of the second door, the design of the relief portion prevents a transversely extended wire harness in the hinge area of the first door from hindering the assembly of the second door with the second hinge. Specifically, in this implementation, the mounting structure of the second hinge is improved. The relief portion is arranged on the second hinge to prevent the extended wire harness of the first door from hindering the assembly of the second door. This may facilitate the assembly operation of the refrigeration appliance, so that the refrigeration appliance in this implementation may employ a production process of first assembling the first door and then assembling the second door during online production of a door-on-door product with wire harness connection. The door assembly manner is more in line with the ergonomics. Further, the relief portion is integrated into the second hinge, so that the first door and the second door may retain the original structures, and more space on the door may be reserved for other structures, thereby achieving a more compact and proper layout for the structures on the door.

Optionally, the relief portion is adapted to enable direct or indirect communication between the connection accommodating portion and the wire harness hole. The design of the relief portion facilitates smooth entry of the first wire harness extending out through the wire harness hole into the connection accommodating portion, thereby ensuring reliable electrical connection between the first wire harness and the second wire harness in the connection accommodating portion.

Optionally, during movement of the second hinge with the second door away from or toward the first door, the relief portion is adapted to prevent interference between the second hinge and the part of the first wire harness extending out through the wire harness hole. Through the relief portion, it is ensured that no interference occurs between the movement trajectory of the second hinge and the extended first wire harness during the assembly of the second door, thereby effectively preventing the extended first wire harness from hindering the assembly or disassembly of the second door with the second hinge.

Optionally, an edge of the second hinge has a first flanging extending upward, and the relief portion includes a first notch provided on the first flanging. The first notch is at least partially open toward the body. The first flanging is adapted to be fitted to the hinge cover to jointly define a space for receiving the first wire harness. In this implementation, a part of the first flanging in an assembly direction of the second door that may hinder extension of the first wire harness is dug out to form a first notch, so as to avoid interference between the first flanging and the first wire harness extending out during movement of the second door, for example, during pushing of the second door toward the first door.

Optionally, the second hinge further includes a first portion configured to be fixed to the second mounting portion, the relief portion includes a second notch, and the second notch is formed by recessing an edge of the first portion inward. Through active avoidance of an area facing the wire harness hole after the second hinge is mounted to the second mounting portion, the interference between the second hinge and the extended first wire harness may be further prevented during pushing of the second door toward the first door.

Optionally, the refrigeration appliance further includes a shielding portion arranged on the first door. The shielding portion is configured to at least shield the relief portion from a rear of the first door. Through the arrangement of the corresponding shielding portion on the first door to shield the structural gap caused by the relief portion after the second hinge is mounted in place, an appearance effect is improved.

Optionally, the second mounting portion includes a groove recessed downward from the first mounting portion, the shielding portion includes a first protruding rib, and the first protruding rib extends from a first side wall of the groove away from the first mounting portion toward a second side wall close to the first mounting portion. Through the arrangement of the first protruding rib behind the groove, the relief portion arranged on the second hinge may be shielded from the rear after the second hinge is mounted to the second mounting portion.

Optionally, the first protruding rib extends to contact or be close to an edge of the relief portion, to shield the relief portion from the rear of the first door. In this way, the relief portion and the first protruding rib may approximately form a concave-convex structure, so that an appearance of the first door remains substantially intact when viewed from the rear. When the first door is opened, an area visible to a user has no obvious gap, thereby optimizing the overall appearance effect of the first door.

Optionally, the first door further includes a second protruding rib located above the wire harness hole and protruding outward from a wall where the wire harness hole is located. This can prevent external foreign objects, liquids, and the like from entering the wire harness hole and affecting electrical performance.

Optionally, the refrigeration appliance further includes a second hinge cover configured to cover the second hinge. The second protruding rib is located below the second hinge cover. In this way, the appearance effect of the hinge mounting area of the first door may be optimized.

Optionally, the refrigeration appliance further includes a second hinge cover configured to cover the second hinge. The second protruding rib is located in a projection range of the second hinge cover in the height direction of the refrigeration appliance. Through the arrangement of the second protruding rib in the area that may be covered by the second hinge cover, the top appearance of the refrigeration appliance may be optimized.

Optionally, one of the second hinge and the first door is provided with a stop portion, and the other of the second hinge and the first door is provided with a fitting portion. The stop portion is configured to be fitted to the fitting portion to limit a maximum distance by which the second hinge moves toward the first door with the second door. This facilitates the assembly operation of the second door, so that the second door may be assembled in place quickly.

Optionally, the stop portion includes a stop rib arranged on the first door and located in front of the wire harness hole, and the fitting portion includes an extension extending outward from the second hinge. Projections of the extension and the stop rib in a thickness direction of the first door at least partially overlap. In this way, an extent to which the second hinge is allowed to retreat backward may be reliably limited, thereby preventing the second hinge from moving backward excessively and impacting the first door or even damaging the body. Further, through stop of the non-relief portion of the second hinge in front of the wire harness hole, the second hinge may be prevented from being excessively close to the first door and contacting the part of the first wire harness extending out through the wire harness hole.

Optionally, the second mounting portion includes a groove recessed downward from the first mounting portion. The wire harness hole is provided in one of a pair of opposite side walls of the groove in a width direction of the first door. The design of the groove reserves a sufficient height difference between the second hinge and the first hinge, which increases a position adjustment space for the door body in the height direction, thereby avoiding interference between the first hinge and the second hinge. Furthermore, the position design of the wire harness hole enables the first wire harness to extend transversely within the first door and extend out through the wire harness hole. This not only facilitates routing of the first wire harness within the first door, but also ensures that the first wire harness can reach the accommodating portion by only a short distance to be electrically connected to the second wire harness.

Other features which are considered as characteristic for the invention are set forth in the appended claims.

Although the invention is illustrated and described herein as embodied in a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

100—Refrigeration appliance; 101—Box body; 102—Storage compartment; 103—Third hinge; 104—First shaft sleeve; 105—Fourth hinge; 106—Fourth shaft hole; 107—Fourth hinge shaft; 108—Automatic door opening hinge; 109—First detector; 110—Control and/or power module; 1—First door; 1*a*—First side: 1*b*—Second side; 10—First mounting portion; 11—Second mounting portion; 12—Groove; 12*a*—First side wall; 12*b*—Second side wall; 12*c*—Bottom wall; 13—Wire harness hole; 14—First wire harness; 141—First electrical connector; 15—Second protruding rib; 16—First magnetic body; 17—Positioning bump; 18—Second detector; 181—Cover portion; 182—Accommodating cavity; 19—Third wire harness; 2—Second door; 21—Second wire harness; 211—Second electrical connector; 22—Latch; 23—Receiving portion; 231—Second shaft hole; 24—Second magnetic body; 3—First hinge; 31—First hinge cover; 32—First shaft hole; 4—Second hinge; 41—Avoidance portion; 411—First notch; 412—Second notch; 42—First flanging; 43—First portion; 431—Positioning through hole; 44—Second hinge cover; 45—Connection accommodating portion; 46—Separator; 461—First arm; 462—Second arm; 463—Fixing post; 47—Hinge shaft; 5—Shielding portion; 51—First protruding rib; 6—Stop portion; 61—Stop rib; 7—Fitting portion; 71—Extension; 300—top unit; x—Width direction of first door; y—Thickness direction of first door; z—Height direction of first door.

In order to make the foregoing objectives, characteristics, and advantages of the present invention clearer and easier to understand, specific embodiments of the present invention are described in detail below with reference to drawings.

Figure 1:
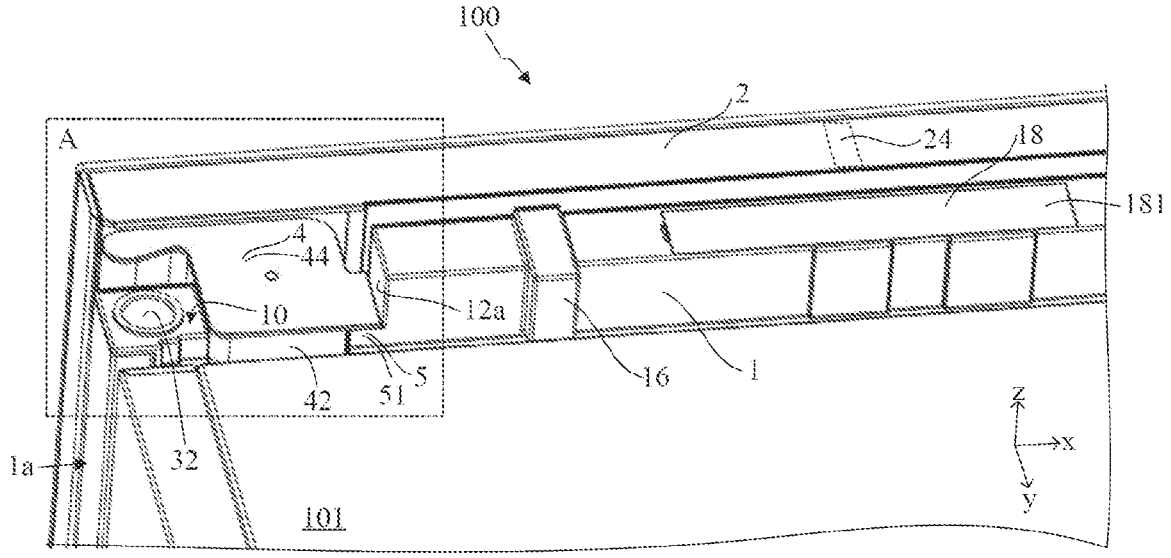
FIG. 1 is a partial, perspective view of a refrigeration appliance according to an embodiment of the invention.
Figure 2:
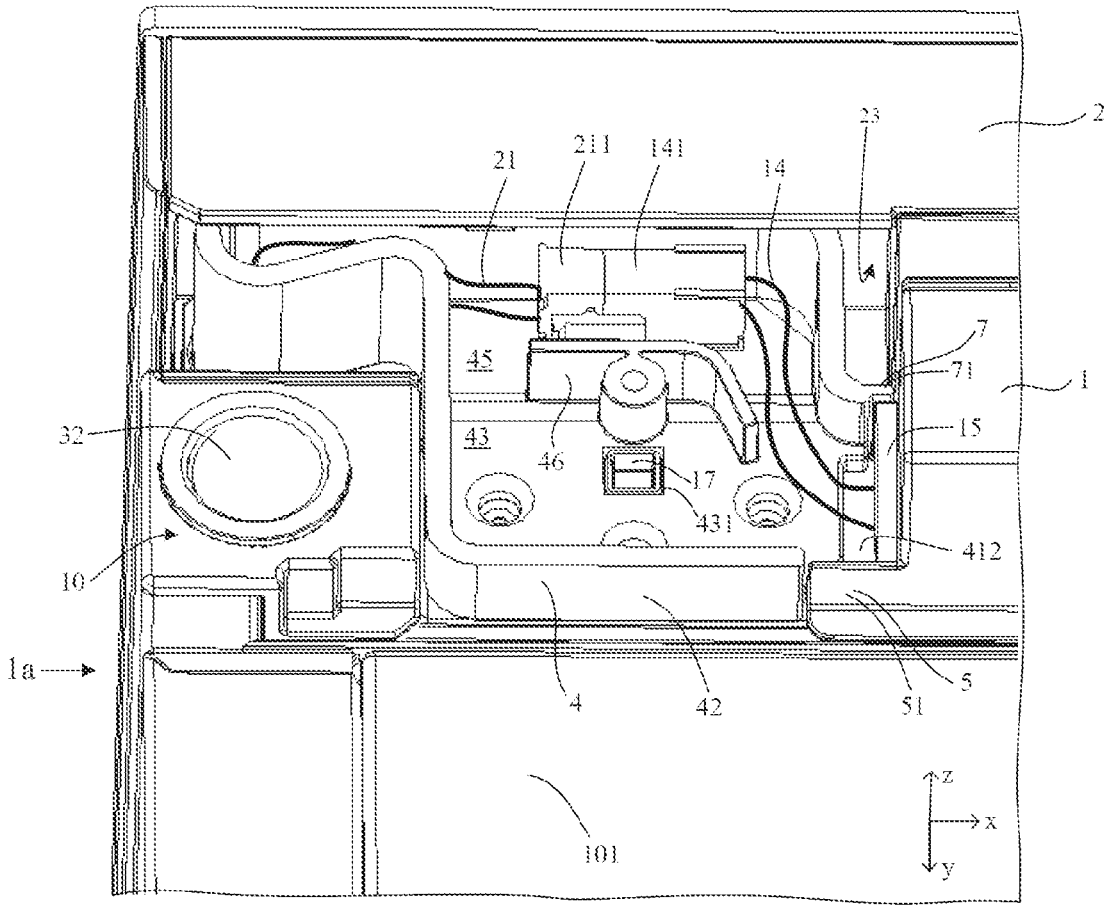
FIG. 2 is a partial, enlarged, perspective view of region A shown in FIG. 1.
Figure 3:
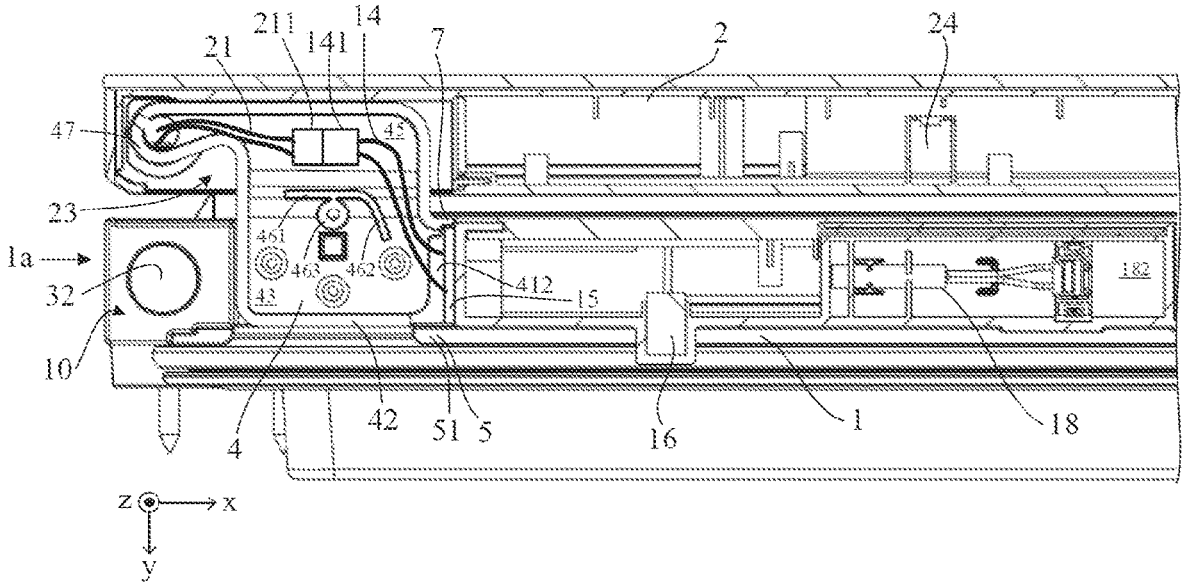
FIG. 3 is a top view of the appliance shown in FIG. 1.
Figure 4:
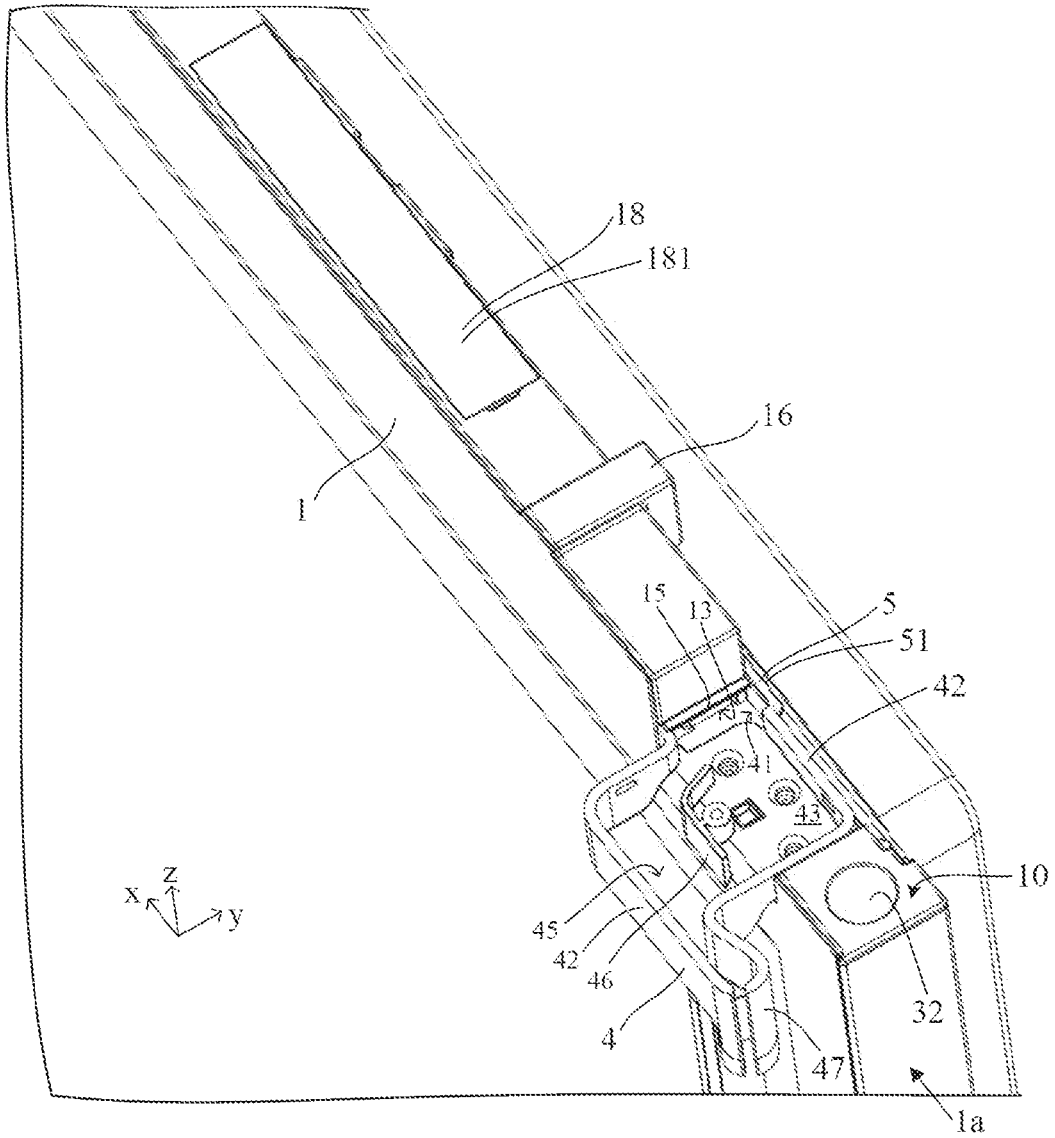
FIG. 4 is a perspective view of a first door and a second hinge shown in FIG. 1.
Figure 5:
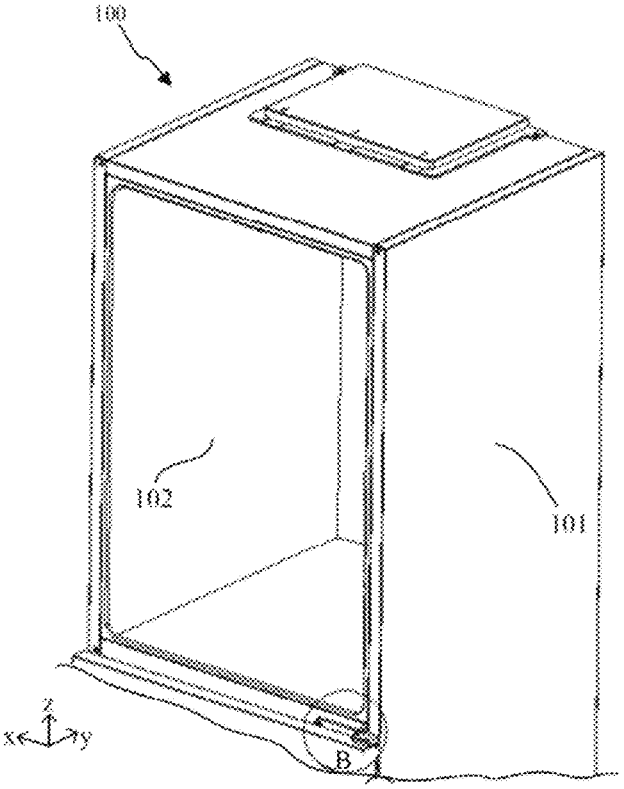
FIGS. 5 to 8 are perspective views of an assembly process of the refrigeration appliance according to an embodiment of the invention.

Referring now to the figures of the drawings in detail and first, particularly to FIG. 1 thereof, there is shown a partial schematic structural diagram of a refrigeration appliance 100 according to an embodiment of the present invention. FIG. 2 is a partial enlarged view of region A shown in FIG. 1. FIG. 3 is a top view of the structure shown in FIG. 1. FIG. 4 is a schematic assembled diagram of a first door 1 and a second hinge 4 shown in FIG. 1. To illustrate technical features of this embodiment more clearly, FIGS. 1 to 3 mainly exemplarily show a structure near a top hinge of the refrigeration appliance 100, a top surface of the door is removed in FIG. 3, and a second hinge cover 44 is removed in FIGS. 2 and 4.

Further, FIGS. 5 to 8 are schematic diagrams of an assembly process of the refrigeration appliance 100 according to an embodiment of the present invention. FIGS. 9 to 15 are partial enlarged views of a connection area between the first door 1 and a body 101 and a connection area between a second door 2 and the first door 1 in FIG. 5 to FIG. 8. FIG. 3 is an exemplary diagram of an assembly effect of assembling the second door 2 to the first door 1 based on a perspective shown in FIG. 15. To display more structural details more clearly, some of the drawings do not show a first hinge 3 and a first hinge cover 31.

The refrigeration appliance 100 in this embodiment may be, for example, a refrigerator, a freezer, or the like. Specifically, with reference to FIGS. 1 to 15, the refrigeration appliance 100 includes the body 101, the first door 1 located in front of the body 101, and the second door 2 located in front of the first door 1.

For ease of expression, in this implementation, a width direction of the first door 1 and the second door 2 is denoted as a direction x, a thickness direction is denoted as a direction y, and a height direction is denoted as a direction z. In this implementation, front and rear directions are respectively the direction y and an opposite direction thereof when the first door 1 disables access to a storage compartment 102. A front or a front side is a direction facing a user during use of the refrigeration appliance 100, and a rear or a rear side is a direction facing away from the user during use of the refrigeration appliance 100. When the first door 1 disables access to the body 101, the direction x is parallel to a width direction of the refrigeration appliance 100, the direction y is parallel to a depth direction of the refrigeration appliance 100, and the direction z is parallel to a height direction of the refrigeration appliance 100.

Further, the body 101 is configured to define at least one storage compartment 102. The storage compartment 102 may include a freezing compartment, a refrigerating compartment, or a greenhouse. The first door 1 is configured to open to enable access or close to inhibit access to one of the at least one storage compartment 102. The second door 2 is configured to open to enable access or close to inhibit access to a storage space on the first door 1 (not shown) open forward.

The user may open only the second door 2 to retrieve and store items in the storage space, or may open both the first door 1 and the second door 2 to retrieve and store items in the storage compartment 102. The storage space may be configured to store cosmetics, for example. The first door 1 and the second door 2 may be collectively referred to as a door-on-door (DonD for short) system, and the corresponding refrigeration appliance 100 may be, for example, a double-door refrigerator.

Further, either of the first door 1 and the second door 2 includes a front shell defining a front surface of the door and a rear shell defining a rear surface of the door. The rear shell faces the body 101 when the door disables access to the storage compartment 102 (or the storage space). The door further includes a frame arranged along a periphery of the door, specifically including a transverse end cover and a vertical edge clamp. The transverse end cover is adapted to define a side end surface of the door extending in the width direction of the door, and the vertical edge clamp is adapted to define a side end surface of the door extending in the height direction of the door.

Further, either of the first door 1 and the second door 2 may include a thermal insulation space filled with a thermally insulative material (not shown in the figure). The thermal insulation space is located between the front shell and the rear shell of the door. The first door 1 is used as an example. When the first door 1 disables access to the storage compartment 102, a thermal insulation layer formed by the thermal insulation space provides thermal insulation to ensure that the storage compartment 102 has a desirable refrigerating/freezing effect. In some embodiments, the front shell forms at least part of a front boundary of the thermal insulation space, so that the thermally insulative material contacts a rear side of the front shell. In some other embodiments, another door panel layer may be further arranged on the rear side of the front shell. The front shell may be made of glass or ceramic panels. The thermally insulative material may be, for example, a foaming liquid.

The first door 1 may be connected to the body 101 through a first hinge unit and may rotate about a hinge shaft of the first hinge unit to open to enable access or close to inhibit access to the storage compartment 102. In terms of an arrangement position, the first hinge unit may include the first hinge 3 and a third hinge 103 respectively located on an upper side and a lower side of the first door 1 in the direction z. The first hinge 3 may also be referred to as an upper door box hinge, and the third hinge 103 may also be referred to as a middle door box hinge. The first door 1 may include a first mounting portion 10 configured to mount the first hinge 3 and a mounting portion configured to mount the third hinge 103. The first door 1 may have a first side 1*a* and a second side 1*b* opposite to each other in the width direction (for example, the direction x). The first hinge unit may be arranged on the first side 1*a*, and a handle for grasp by the user may be arranged on the second side 1*b*. That is to say, the first side 1*a* may be considered as a hinge side of the first door 1, and the second side 1*b* may be considered as a handle side of the first door 1.

The second door 2 may be connected to the first door 1 through a second hinge unit and may rotate about a hinge shaft of the second hinge unit to open to enable access or close to inhibit access to the storage space. In terms of an arrangement position, the second hinge unit may include a second hinge 4 and a fourth hinge 105 respectively located on an upper side and a lower side of the second door 2 in the direction z. The second hinge 4 may also be referred to as a DonD upper hinge, and the fourth hinge 105 may be referred to as a DonD lower hinge. The first door 1 may include a second mounting portion 11 configured to mount the second hinge 4 and a mounting portion configured to mount the fourth hinge 105.

Figure 10:
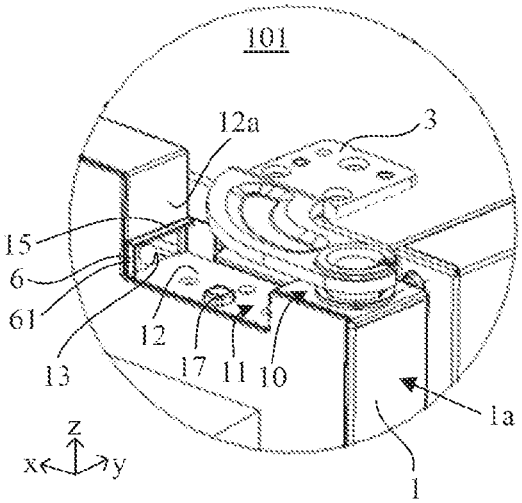
FIG. 10 is a partial, enlarged, perspective view of region C shown in FIG. 6.
Figure 14:
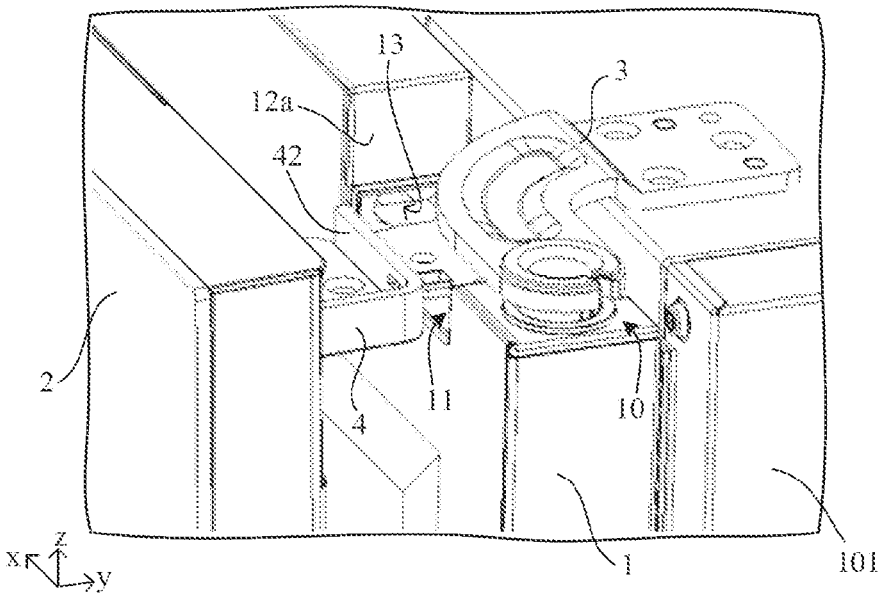
FIGS. 14 and 15 are partial, enlarged, perspective views of region G in FIG. 8 shown from different perspectives.
Figure 15:
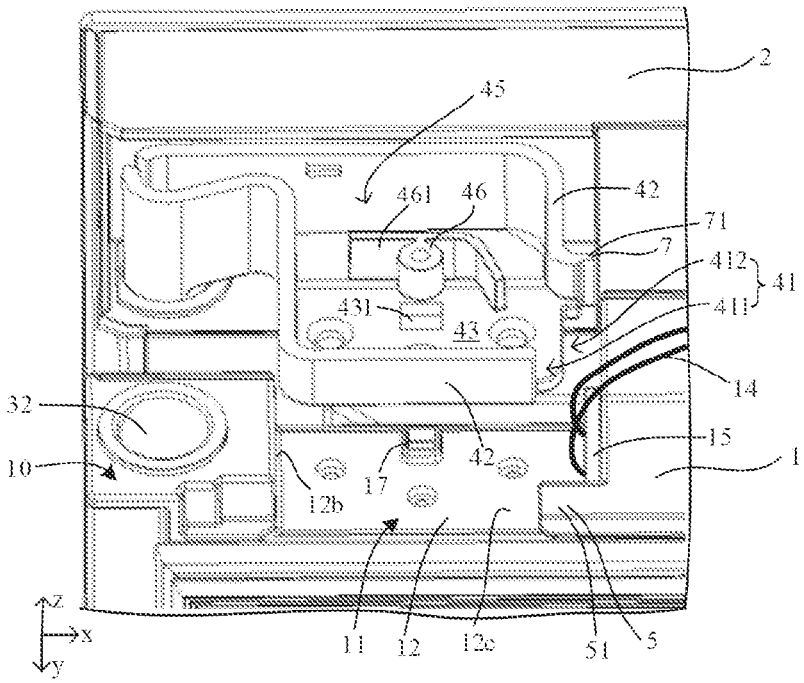

In a specific implementation, with reference to FIG. 10, FIG. 14, and FIG. 15, the second mounting portion 11 may include a groove 12 recessed downward from the first mounting portion 10. The second hinge 4 is fixed in the groove 12 of the second mounting portion 11, to reserve a sufficient height difference between the second hinge 4 and the first hinge 3 fixed to the first mounting portion 10. In this way, a position adjustment space of the door body (for example, the first door 1 and the second door 2) in the height direction may be increased, thereby avoiding interference between the first hinge 3 and the second hinge 4.

Further, the groove 12 may have a bottom wall 12*c* and a pair of side walls (respectively denoted as a first side wall 12*a* and a second side wall 12*b*) located on two opposite sides of the bottom wall 12*c* in the width direction (that is, the direction x) of the first door 1. The second side wall 12*b* is closer to the first mounting portion 10 than the first side wall 12*a*.

Figure 16:
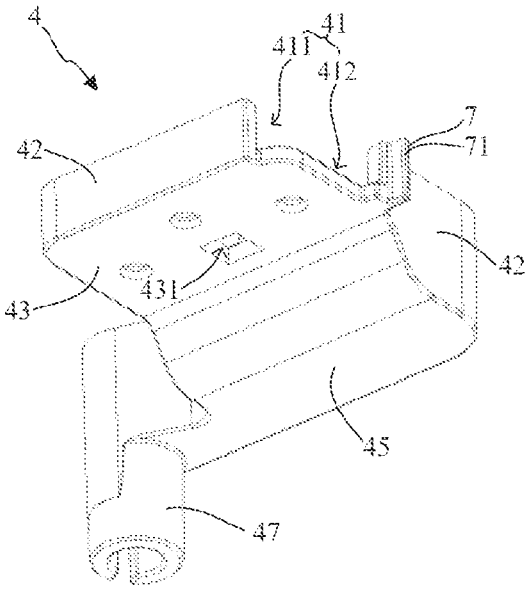
FIG. 16 is a perspective view of a second hinge according to an embodiment of the invention.

Further, with reference to FIG. 2 to FIG. 4, FIG. 15, and FIG. 16, the second hinge 4 may include a first portion 43 configured to be fixed to the second mounting portion 11. For example, the first portion 43 may be fixed to the bottom wall 12*c* through a fastener such as a screw. FIG. 16 is a schematic diagram of the second hinge 4 according to an embodiment of the present invention. It should be pointed out that, in this implementation, the number and arrangement positions of screw holes on the first portion 43 and the bottom wall 12*c* configured for fitting the fastener are not specifically limited. The figure exemplarily shows three screw holes distributed in the first portion 43 and the bottom wall 12*c* in a triangular shape. In an actual application, the number and the arrangement positions of the screw holes may be adjusted as required.

In some embodiments, referring to FIG. 10 and FIG. 16, the second mounting portion 11 may be provided with a positioning bump 17, and the first portion 43 may be provided with a positioning through hole 431 extending through the second hinge 4 in the direction z. The positioning bump 17 is adapted to be inserted into the positioning through hole 431 to prevent movement of the second hinge 4 (especially the first portion 43) in the groove 12, as shown in FIG. 2 to FIG. 4. In this way, it may be ensured that the screw holes on the second hinge 4 are aligned to the screw holes on the groove 12 in a one-to-one correspondence.

In a specific implementation, the second door 2 may have an electrical component that may consume power (not shown in the figure). The electrical component may include but is not limited to at least one of a lighting element, a display and/or control module, a heater, a sensor, and a component adapted to be driven by power.

Figure 12:
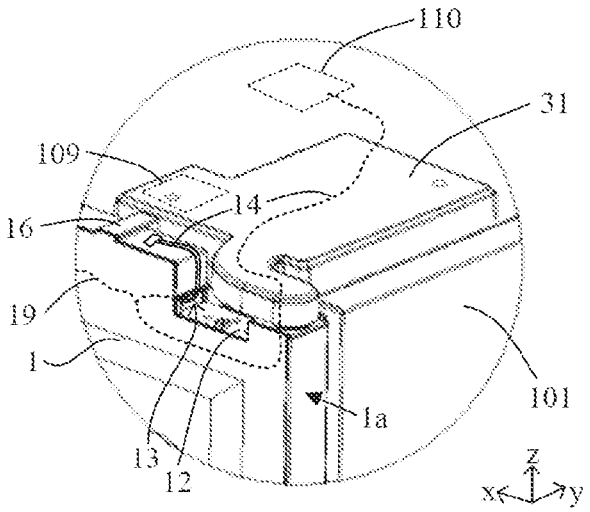
FIG. 12 is a partial, enlarged, perspective view of region E shown in FIG. 7.

Specifically, the electrical component may be electrically connected to a relevant component (for example, a control and/or power module 110 exemplarily shown in FIG. 12) on the body 101 through a transmission line. The control and/or power module 110 transmits a power and/or control signal to the electrical component through a transmission line.

Further, still referring to FIG. 3 and FIG. 12, the transmission line may include a first wire harness 14 extending from the body 101 into the first door 1 through the first hinge 3 and extending out from the first door 1. The first door 1 may include a wire harness hole 13 facing the second mounting portion 11, for the first wire harness 14 located inside the first door 1 to extend to or be electrically connected to outside of the first door 1.

Figure 13:
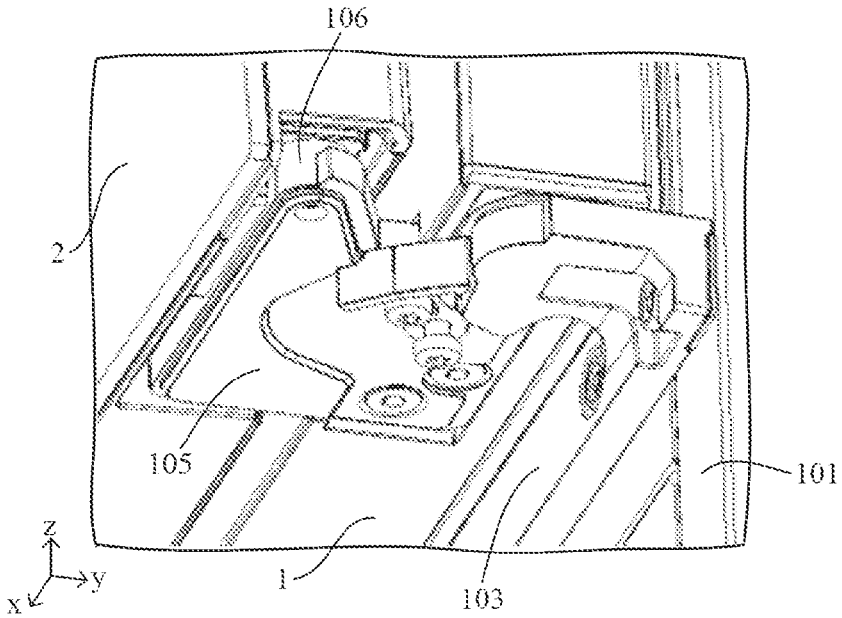
FIG. 13 is a partial, enlarged, perspective view of region F shown in FIG. 8.

In some embodiments, with reference to FIG. 10, FIG. 12, and FIG. 13, the wire harness hole 13 may be provided in one of the pair of side walls of the groove 12. For example, the wire harness hole 13 may be provided on the first side wall 12*a* further away from the first mounting portion 10. In this way, the first wire harness 14 may extend transversely within the first door 1 and extend out through the wire harness hole 13. This not only facilitates routing of the first wire harness 14 within the first door 1, but also ensures that the first wire harness 14 can reach a connection accommodating portion 45 located at the second hinge 4 by only a short distance to be electrically connected to the second wire harness 21.

In some embodiments, the first wire harness 14 may extend into the thermal insulation space of the first door 1, and extend out of the first door 1 from the thermal insulation space through the wire harness hole 13 and then extend toward the second door 2.

Further, referring to FIG. 3, the first wire harness 14 may include a first electrical connector 141 located at the connection accommodating portion 45 and a cable extending from the first electrical connector 141.

Further, still referring to FIG. 3, the transmission line may further include a second wire harness 21 located in the second door 2. The second wire harness 21 may be arranged in the thermal insulation space of the second door 2. One end of the second wire harness 21 is electrically connected to the electrical component, and the other end extends out of the second door 2 through a hinge shaft 47 of the second hinge 4 and is electrically connected to the first wire harness 14 at the connection accommodating portion 45.

The second wire harness 21 may include a second electrical connector 211 located at the connection accommodating portion 45 and a cable extending from the second electrical connector 211.

In some embodiments, the first electrical connector 141 and the second electrical connector 211 are fitted (also referred to as inserted or coupled) at the connection accommodating portion 45 to electrically connect the first wire harness 14 and the second wire harness 21.

In this way, the power and/or control signal can smoothly reach the electrical component through the first wire harness 14 and the second wire harness 21 from the relevant component of the body 101, or vice versa.

In a specific implementation, still referring to FIGS. 1 to 4, FIG. 15, and FIG. 16, the second hinge 4 may include the connection accommodating portion 45, the second wire harness 21 extending out through the hinge shaft 47 of the second hinge 4, and the first wire harness 14 extending out of the first door 1 through the wire harness hole 13. The second wire harness and the first wire harness may extend to the connection accommodating portion 45 and be electrically connected here. Through integration of the connection accommodating portion 45 into the second hinge 4, an upper end of the first door 1 may be more intact, thereby facilitating manufacturing.

Further, the connection accommodating portion 45 is at least partially located outside a projection range of the first door 1 in the height direction (for example, the direction z) of the refrigeration appliance 100.

For example, referring to FIGS. 2 to 4, the connection accommodating portion 45 is located outside the projection range of the first door 1 in the direction z. In this way, the connection accommodating portion 45 does not occupy any space of the first door 1, so that the upper end of the first door 1 is more intact, and more space may be provided for other components. Therefore, a layout of the other components arranged at a top of the first door 1 is less likely to be limited. The other components may be, for example, a detection component configured to detect an opening/closing state of the first door 1 and/or the second door 2, a humidity sensor or a temperature sensor, a user interface module (UIM), or a light component.

In some embodiments, the first electrical connector 141 and the second electrical connector 211 are fitted in an area outside the first door 1, as shown in FIG. 3.

The connection accommodating portion 45 or at least part of the connection accommodating portion is removed out of the first door 1, the upper end of the first door 1 is more intact, thereby facilitating manufacturing. Further, after the connection accommodating portion 45 is removed, more space may be spared on the first door 1 for the other components, thereby optimizing a structural layout on the first door 1.

In a specific implementation, the connection accommodating portion 45 and the first portion 43 may be arranged side by side on the second hinge 4. For example, the connection accommodating portion 45 may be located on a side of the first portion 43 away from the body 101 in the direction y.

Further, a side of the first portion 43 away from the hinge shaft 47 of the second hinge 4 in the direction x may accommodate the connection accommodating portion 45, so as to accommodate a part of the first wire harness 14 extending out through the wire harness hole 13 after the second hinge 4 is mounted to the second mounting portion 11, as shown in FIG. 2 and FIG. 3.

In some embodiments, still further to FIG. 4 and FIG. 16, in the direction z, the connection accommodating portion 45 may be located below the first portion 43. That is to say, the connection accommodating portion 45 may be formed by a part of the second hinge 4 moving forward in the direction y from the first portion 43 and sinks downward in the direction z. In this way, the connection accommodating portion 45 may have a higher space in the direction z. This ensures that the first electrical connection 141 and the second electrical connector 211 located therein are lower than a first flanging 42 arranged around the second hinge 4, thereby preventing the second hinge cover 44 from being pushed up by the excessively high first electrical connection 141 and second electrical connector 211.

Figure 17:
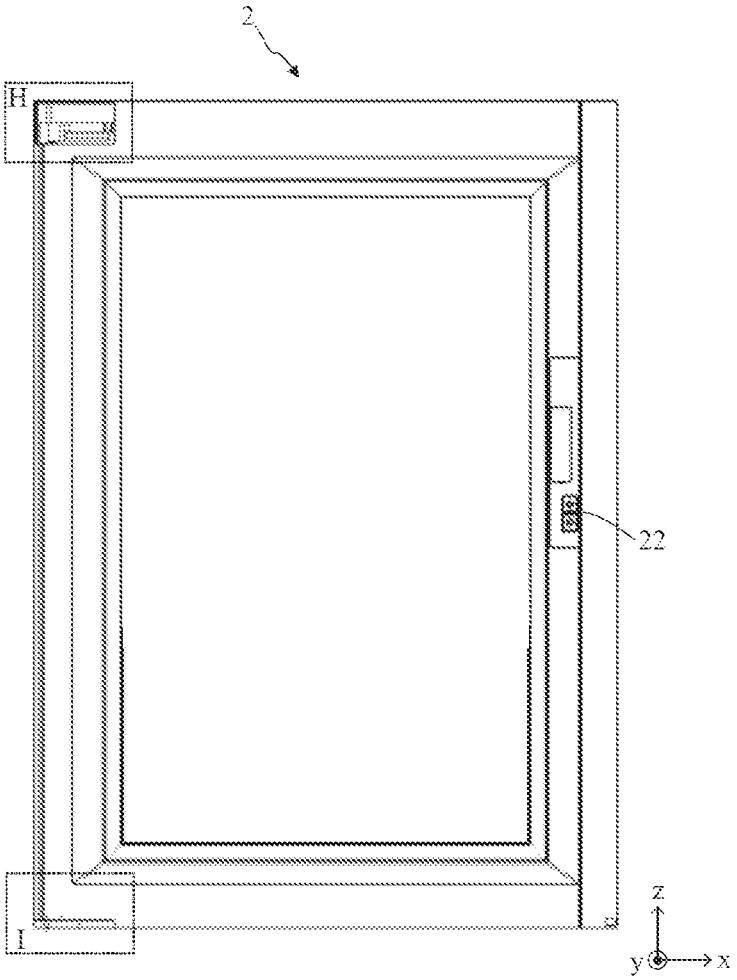
FIG. 17 is an illustration of a second door and a second hinge according to an embodiment of the invention.
Figure 18:
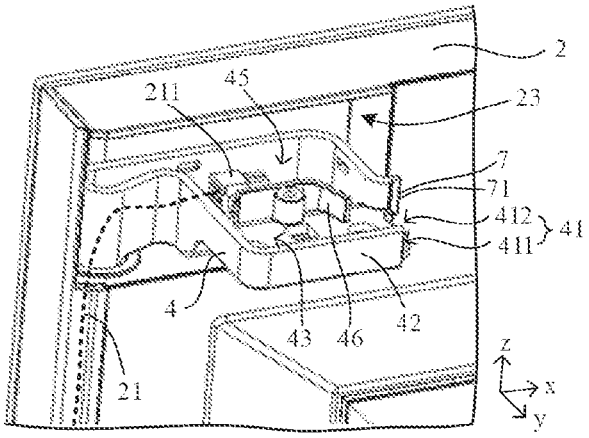
FIG. 18 is a partial, enlarged, perspective view of region H shown in FIG. 17.

In a specific implementation, still referring to FIG. 2, FIG. 3, FIG. 15, FIG. 17, and FIG. 18, the connection accommodating portion 45 is at least partially located outside a projection range of the second door 2 in the height direction (for example, the direction z) of the refrigeration appliance 100. FIG. 17 is a schematic pre-assembled diagram of the second door 2 and the second hinge 4 according to an embodiment of the present invention. FIG. 18 is a partial enlarged view of a region H in FIG. 17.

Specifically, a part of the connection accommodating portion 45 located outside the projection range of the first door 1 in the direction z may be substantially received by the second door 2. For example, referring to FIG. 3, the connection accommodating portion 45 is located in front of the first door 1 in the direction y, and substantially falls within the projection range of the second door 2 in the direction z.

The connection accommodating portion 45 or a part of the connection accommodating portion is transferred to the second door 2, that is, the connection accommodating portion 45 is arranged on an outer door of the DonD system, so that an increase in a size of the refrigeration appliance 100 in the width direction (for example, the direction x) is avoided when the connection accommodating portion 45 is removed out of an inner door.

Figure 19:
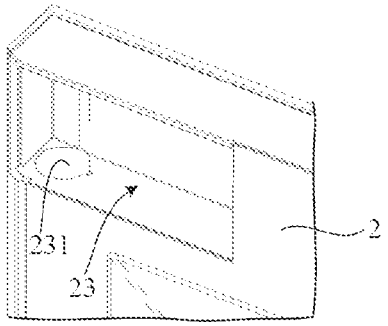
FIG. 19 is a partial, enlarged, perspective view of the second door in the region H shown in FIG. 17.

Further, referring to FIG. 19, the second door 2 may include a receiving portion 23 configured to receive the part of the connection accommodating portion 45 located outside the projection range of the first door 1 in the direction z. For example, the receiving portion 23 may be located at an upper hinge of the second door 2, and may be formed through forward recession in the direction y from a rear wall of the second door 2 facing the first door 1. In this way, an increase in the size of the refrigeration appliance 100 in the width direction is avoided when the connection accommodating portion 45 is removed out of the inner door.

In a specific implementation, projections of the connection accommodating portion 45 and the hinge shaft 47 of the second hinge 4 in the direction y may at least partially overlap. In this way, the second wire harness 21 extending out through the hinge shaft 47 of the second hinge 4 may reach the connection accommodating portion 45 by a shortest distance, as shown in FIG. 18.

Further, the receiving portion 23 may be provided with a second shaft hole 231 for receiving the hinge shaft 47 of the second hinge 4.

In a specific implementation, still referring to FIG. 2 to FIG. 4, FIG. 15, and FIG. 18, a separator 46 may be arranged between the connection accommodating portion 45 and the first portion 43 to limit the first wire harness 14 and the second wire harness 21 located in the connection accommodating portion 45, especially prevent the first electrical connector 141 and the second electrical connector 211 from entering the first portion 43.

Through the arrangement of the separator 46 to spatially isolate the connection accommodating portion 45 of the second hinge 4 for accommodating the transmission line from the first portion 43 configured to be fixed to the second mounting portion 11, function interference between can be reliably prevented therebetween. For example, during fixation of the first portion 43 to the groove 12, the separator 46 can effectively limit the first electrical connector 141 and the second electrical connector 211 in the connection accommodating portion 45, thereby avoiding any impact on a screwing action as a result of unlimited movement of the first electrical connector 141 and the second electrical connector 211 in the second hinge 4.

Further, the separator 46 may include a first arm 461 that extends substantially in the direction x, and the first arm 461 may serve as a partition wall between the connection accommodating portion 45 and the first portion 43. The first arm 461 may provide a stop function, to prevent the first electrical connector 141 and the second electrical connector 211 from moving toward the first door 1 in the direction y to enter the first portion 43.

Further, the separator 46 may further include a second arm 462. The second arm 462 extends from an end of the hinge shaft 47 of the first arm 461 away from the second hinge 4 in the directions x and y. The second arm 462 may provide a guide function, to guide the first wire harness 14 extending out through the wire harness hole 13 to reach the connection accommodating portion 45.

In some embodiments, the separator 46 may support the second hinge cover 44. Specifically, a top of the separator 46 in the direction z may be flush with the first flanging 42, to provide a support point near a center of the second hinge 4, thereby preventing downward recession of the second hinge cover 44.

In some embodiments, a fixing post 463 may be integrally formed on the separator 46, and the second hinge cover 44 is fixed to the fixing post 463 through a fastener. Referring to FIG. 1 to FIG. 4, the fixing post 463 may be, for example, a stud, and a screw hole is provided on the second hinge cover 44. When the second hinge cover 44 is to cover the second hinge 4, the screw hole is aligned to the stud, and a screw is inserted into the stud through the screw hole to fix the second hinge cover 44 to the second hinge 4.

Further, the fixing post 463 may be located on a side of the first arm 461 facing the first portion 43, to avoid occupying a space of the connection accommodating portion 45.

In some embodiments, the separator 46 may be located outside a projection range of the first door 1 in the direction z. In this way, the space on the first door 1 may be further released. For example, a part of the second hinge 4 located within the projection range of the first door 1 in the direction z may mainly be the first portion 43 configured to be fixed to the groove 12. All other structures except for the first portion 43 are moved to the first door 1.

In a specific implementation, the refrigeration appliance 100 may include a top unit 300 arranged at the top of the first door 1. The top unit 300 may be configured for detection, operation, or control of the refrigeration appliance 100. Further, the top unit 300 may be arranged closer to the first side 1*a* than to the second side 1*b* of the first door 1. That is to say, the top unit 300 may be arranged closer to the first hinge 3.

In some embodiments, the top unit may include one or more of a detection unit, a sensing unit, an operating unit, or a control unit. For example, the top unit may include a UIM, a printed circuit board (PCB), a detection component, and the like.

In some embodiments, the top unit may be an electrical component, and obtains the power and/or control signal through the first wire harness 14 inside the first door 1.

Through the arrangement of the connection accommodating portion 45 on the second hinge 4, more space on the upper end of the first door 1, especially near the first hinge 3 may be released to the top unit. In this way, the top unit may be arranged more flexibly, for example, may be arranged as close as possible to the first hinge 3. In this way, a cable in the body may be electrically connected to the top unit by only a short distance, thereby reducing wiring complexity inside the first door.

In a specific implementation, still referring to FIG. 1, FIG. 3, FIG. 4, and FIG. 12, the top unit may include a detection component configured to detect an opening/closing state of the first door 1 and/or the second door 2. Specifically, through the arrangement of the detection component at a proper position in the refrigeration appliance 100, whether the first door 1 is closed relative to the body 101 may be sensed, and/or whether the second door 2 is closed relative to the first door 1 may be sensed. If it is detected that the first door 1 and/or the second door 2 are not closed for a long time, an alarm is sent to prompt the user to close the first door 1 and/or the second door 2 in a timely manner.

In a specific implementation, the detection component may include a first detector 109 arranged on one of the body 101 and the first door 1 and a first magnetic body 16 arranged on the other of the body 101 and the first door 1. Specifically, the first detector 109 and the first magnetic body 16 cooperate to detect whether the first door 1 is opened relative to the body 101.

FIG. 1, FIG. 3, FIG. 4, and FIG. 12 exemplarily show that the first detector 109 is arranged on the body 101 and the first magnetic body 16 is arranged on the first door 1. In this way, electrical connection between the first detector 109 and a relevant component may be completed inside the body 101. This reduces a number of cables that need to extend through the first hinge 3, thereby improving smoothness of opening/closing of the first door 1. Certainly, in an actual application, the first magnetic body 16 may alternatively be arranged on the body 101, and the first detector 109 may alternatively be arranged on the first door 1.

The first detector 109 may be, for example, a magnetic read switch, and the first magnetic body 16 may be, for example, a permanent magnet.

In some embodiments, a direction from the first magnetic body 16 toward the first detector 109 may be substantially parallel to the direction y. That is to say, the first magnetic body 16 is arranged at a position on the first door 1 directly facing the first detector 109 when the first door 1 is at a position where access to the body 101 is disabled, to help ensure a high sensing precision.

In some embodiments, both the first detector 109 and the first magnetic body 16 may be arranged close to the first hinge 3. For example, a bulge structure may be arranged at a position on the first door 1 near the wire harness hole 13 to accommodate the first magnetic body 16. Correspondingly, the first detector 109 may be arranged near the first hinge 3 and located directly behind the bulge structure when the first door 1 disables access to the body 101.

In this example, the first detector 109 and the first magnetic body 16 are arranged closer to the hinge side of the first door 1 than to the handle side of the first door 1.

In addition, if the first detector 109 is arranged on the first door 1, in this example, the first detector 109 and the first magnetic body 16 are arranged close to the first hinge 3 in such a way that the wire harness (for example, the first wire harness 14) extending out from the body 101 may be electrically connected to the first detector 109 by only a short distance after entering the first door 1 through the first hinge 3. This facilitates cost saving and reduces wiring complexity inside the first door 1.

In this implementation, through the arrangement of the connection accommodating portion 45 outside the first door 1, the first detector 109 and the first magnetic body 16 may be arranged as close as possible to the first hinge 3. For example, at least a distance to the connection accommodating portion 45 may be omitted from a spacing between the first magnetic body 16 and the wire harness hole 13 in the direction x.

In a specific implementation, still referring to FIG. 12, the refrigeration appliance 100 may include the first hinge cover 31 configured to cover the first hinge 3. Specifically, the first hinge cover 31 may be fitted to a top surface of the body 101 to jointly define at least a space for accommodating the first hinge 3.

Further, the first hinge cover 31 may be further configured to cover the first magnetic body 16 or the first detector 109 arranged on the body 101. FIG. 12 exemplarily shows that the first hinge cover 31 covers the first hinge 3 and the first detector 109.

In this implementation, through the arrangement of the connection accommodating portion 45 outside the first door 1, a space may be spared on the first door 1 for arranging the first detector 109 or the first magnetic body 16 as close as possible to the first hinge 3.

In this way, the first hinge cover 31 may cover the first magnetic body 16 or the first detector 109 arranged on the body 101, thereby optimizing a top appearance of the refrigeration appliance 100.

In some embodiments, the bulge structure configured to accommodate the first magnetic body 16 may be higher than the top surface of the body 101 in the direction z, and further, may be flush with the first hinge cover 31. In this way, it is ensured that the first magnetic body 16 and the first detector 109 located within the first hinge cover 31 are on a same plane, thereby achieving a desirable sensing precision.

Further, the bulge structure may protrude toward the body 101 from an upper edge clamp of the first door 1 in the direction y, so as to be closer to the first detector 109 located on the body 101, as shown in FIG. 4.

In a specific implementation, still referring to FIG. 1, FIG. 3, and FIG. 4, the detection component may include a second detector 18 and a second magnetic body 24 respectively arranged on the first door 1 and the second door 2. Specifically, the second detector 18 and the second magnetic body 24 cooperate to detect whether the second door 2 is opened relative to the first door 1.

FIG. 1, FIG. 3, and FIG. 4 exemplarily show that the second detector 18 is arranged on the first door 1 and the second magnetic body 24 is arranged on the second door 2. In this way, a number of electrical components on the second door 2 may be reduced. This reduces a number of cables that need to extend through the second hinge 4, thereby improving smoothness of rotation of the second door 2.

Certainly, in an actual application, the second magnetic body 24 may alternatively be arranged on the first door 1, and the second detector 18 may alternatively be arranged on the second door 2.

The second detector 18 may be, for example, a magnetic read switch, and the second magnetic body 24 may be, for example, a permanent magnet.

In some embodiments, a direction from the second magnetic body 24 toward the second detector 18 may be substantially parallel to the direction y. That is to say, the second magnetic body 24 is arranged at a position on the second door 2 directly facing the second detector 18 when the second door 2 is at a position where access to the first door 1 is disabled, to help ensure a high sensing precision.

In some embodiments, both the second detector 18 and the second magnetic body 24 may be arranged close to the second hinge 4. For example, an accommodating cavity 182 may be arranged at a position on the first door 1 near the first magnetic body 16. A transverse space formed by the accommodating cavity 12 is adapted to accommodate the second detector 18. Correspondingly, when the second door 2 disables access to the first door 1, the second magnetic body 24 arranged on the second door 2 is located directly in front of the accommodating cavity 182.

Further, the first door 1 may be provided with a cover portion 181 to open to enable access or close to inhibit access to the accommodating cavity 182. In this example, the second detector 18 and the second magnetic body 24 are arranged closer to the hinge side of the second door 2 than to the handle side of the second door 2.

Further, still referring to FIG. 1, in the width direction of the refrigeration appliance 100, the first hinge 3, the second hinge 4, the first detector 109, the first magnetic body 16, the second detector 18, and the second magnetic body 24 may be arranged at the top of the refrigeration appliance 100 in sequence from left to right.

In some embodiments, still referring further to FIG. 3 and FIG. 12, a strand of the first wire harness 14 located in the first door 1 may form a third wire harness 19 or be electrically connected to the third wire harness 19. The third wire harness 19 is adapted to be coupled to the second detector 18 located in the accommodating cavity. The second detector 18 arranged near the second hinge 4 enables the third wire harness 19 to extend to the accommodating cavity by only a short distance in the direction x.

In a specific implementation, still referring to FIG. 3, FIG. 15, FIG. 16, and FIG. 18, the second hinge 4 may include a relief portion 41. The relief portion is open toward the body 101 to avoid the part of the first wire harness 14 extending out through the wire harness hole 13.

Specifically, since the connection accommodating portion 45 is located outside the projection of the first door 1 in the direction z, the outward movement design requires the first wire harness 14 and the second wire harness 21 to be connected outside the first door 1.

Therefore, for the refrigeration appliance 100 manufactured in an assembly sequence of first mounting the first door 1 and then mounting the second door 2, after the first door 1 is mounted to the body 101, the first wire harness 14 first extends out through the wire harness hole 13 for subsequent electrical connection to the second wire harness 21 on the second door 2. That is to say, before the second door 2 is mounted to a front of the first door 1, an end of the first wire harness 14 and a part of the cable have already extended out of the first door 1 through the wire harness hole 13, as shown in FIG. 12 and FIG. 15.

Due to the presence of the part of the first wire harness 14 extending out through the wire harness hole 13, a high risk that the second hinge 4 pre-mounted to the second door 2 contacts the part of the first wire harness 14 extending out through the wire harness hole 13 exists during pushing of the second door 2 toward the body 101 in the direction y based on a perspective shown in FIG. 15. To reduce or even avoid the risk of impact, in this implementation, the relief portion 41 is arranged on the second hinge 4 to actively avoid the part of the first wire harness 14 extending out through the wire harness hole 13, thereby ensuring that the assembly movement of the second door 2 in the direction y can be smoothly completed.

Further, the relief portion 41 facing the body 101 is adapted to enable the part of the first wire harness 14 extending out through the wire harness hole 13 to first reach the relief portion 41 without contacting other parts of the second hinge 4 during movement of the second hinge 4 with the second door 2 in the direction y. In this way, an effect of avoiding the extended wire harness on the first door 1 by the second hinge 4 may be effectively achieved.

In a specific implementation, during movement of the second hinge 4 with the second door 2 away from or toward the first door 1, the relief portion 41 is adapted to prevent interference between the second hinge 4 and the part of the first wire harness 14 extending out through the wire harness hole 13. Through the relief portion 41, it is ensured that no interference occurs between a movement trajectory of the second hinge 4 and the extended first wire harness 13 during the assembly of the second door 2, thereby effectively preventing extended the first wire harness 13 from hindering the assembly or disassembly of the second door 2 with the second hinge 4.

In a specific implementation, still referring to FIG. 1, FIG. 3, FIG. 4, FIG. 14 to FIG. 16, and FIG. 18, an edge of the second hinge 4 may be provided with the first flanging 42 extending upward. The first flanging 42 is adapted to be fitted to the second hinge cover 44 to jointly define a space for accommodating at least the first wire harness 14. Specifically, the first flanging 42 may be arranged to surround the edge of the second hinge 4 to form an annular groove. Both the first portion 43 and the connection accommodating portion 45 may be surrounded by the annular groove.

Further, still referring to FIG. 1, the second hinge unit may further include the second hinge cover 44 configured to cover the second hinge 4. A contour shape of a circumferential edge of the second hinge cover 44 is arranged to fit a contour shape of a circumferential edge of the second hinge 4, to completely cover the second hinge 4. When the second hinge cover 44 covers the second hinge 4, corresponding to the second hinge 4, a part of the second hinge cover 44 is located in the groove 12 of the second mounting portion 11, and the other part extends out of the groove 12.

In some embodiments, the edge of the second hinge cover 44 may be provided with a second flanging (not shown) protruding toward the second hinge 4. The second flanging is inserted into the first flanging 42. For example, the second flanging may be arranged to surround the edge of the second hinge cover 44 to form an annular groove. The annular structure formed by the second flanging may have the same shape as the annular structure formed by the first flanging 42, but has a smaller size. In this case, the second flanging may be wholly inserted into the annulus formed by the first flanging 42. In this way, a space for accommodating the transmission line may be formed between the second hinge cover 44 and the second hinge 4.

Further, still referring to FIG. 15, FIG. 16, and FIG. 18, the relief portion 41 may include a first notch 411 provided on the first flanging 42. The first notch 411 is at least partially open toward the body 101. That is to say, in this specific implementation, the annular groove formed by the first flanging 42 around the edge of the second hinge 4 is not a fully enclosed structure. Instead, at least part on a side facing the body 101 is dug out to form the relief portion 41.

The part of the first flanging 42 in an assembly direction of the second door 2 that may hinder extension of the first wire harness 14 is dug out to form the first notch 411, so as to avoid interference between the first flanging 42 and the extended first wire harness 14 during movement of the second door 2 (for example, during pushing of the second door 2 toward the first door 1).

In a specific implementation, still referring to FIG. 2 to FIG. 4, FIG. 15, FIG. 16, and FIG. 18, the first notch 411 may alternatively be open toward the direction x. For example, the first flanging 42 located at a part directly facing the wire harness hole 13 after the second hinge 4 is mounted to the second mounting portion 11 may be removed, to form the first notch 411 facing the direction x and open toward the wire harness hole 13. In this way, the first wire harness 14 extending out through the wire harness hole 13 may enter the second hinge 4 through the first notch 411 by the shortest distance.

In some embodiments, the relief portion 41 is adapted to enable direct or indirect communication between the connection accommodating portion 45 and the wire harness hole 13. Specifically, the first notch 411 may be open toward the body 101 and the wire harness hole 13. That is to say, a part on a side of the second hinge 4 facing the body 101 and a part on a side facing the first side wall 12*a* are both dug out, so that no blocking from the first flanging 42 exists between the wire harness hole 13 and the connection accommodating portion 45 located outside the first door 1 after the second hinge 4 is mounted in place.

The design of the relief portion 41 facilitates smooth entry of the first wire harness 14 extending out through the wire harness hole 13 into the connection accommodating portion 45, thereby ensuring reliable electrical connection between the first wire harness 14 and the second wire harness 21 in the connection accommodating portion 45.

In a specific implementation, still referring to FIGS. 2 to 4, FIG. 15, FIG. 16, and FIG. 18, the relief portion 41 may include a second notch 412. The second notch 412 may be formed by recessing an edge of the first portion 43 inward.

Specifically, after the second hinge 4 is mounted to the second mounting portion 11, the second notch 412 may be formed by recessing the edge of the first portion 43 in a direction away from the wire harness hole 13 (for example, in the direction x).

Generally speaking, before the second door 2 is assembled to the first door 1, the first wire harness 13 extending out through the wire harness hole 13 is folded upward in a direction opposite to the direction in which the first wire harness extends in the first door 1, so as to be temporarily fixed to the upper edge clamp of the first door 1, as shown in FIG. 12. When the cable is bent, an arc is formed at the wire harness hole 13, as shown in FIG. 15. The arc occupies a certain space outside the wire harness hole 13 in the direction x. Therefore, in this specific implementation, for an area near the wire harness hole 13 after the second hinge 4 is mounted to the second mounting portion 11, not only is the first flanging 42 in the area removed, but also is a part of the first portion 43 in the area dug out to form the second notch 412. The relief portion 41 including the first notch 411 and the second notch 412 enables the second hinge 4 to release more space near the wire harness hole 13, thereby more effectively avoiding the part of the first wire harness 14 extending out through the wire harness hole 13.

Through active avoidance of the area facing the wire harness hole 13 after the second hinge 4 is mounted to the second mounting portion 11, the interference between the second hinge 4 and the extended first wire harness 13 may be further prevented during pushing of the second door 2 toward the first door 1.

In some embodiments, the second notch 412 may be at least partially visible to the outside in the height direction (for example, the direction z) of the first door 1, as shown in FIG. 3. Further, in the direction z, the second notch 412 may be located below the second hinge cover 44, as shown in FIG. 1. Through covering of the second notch 412 by the second hinge cover 44, the appearance of the refrigeration appliance 100 is beautified, and external foreign objects are prevented from entering the refrigeration appliance 100 through the second notch 412 and affecting performance of the refrigeration appliance 100.

In a specific implementation, still referring to FIGS. 1 to 4 and FIG. 15, the refrigeration appliance 100 may further include a shielding portion 5 arranged on the first door 1 and at least shielding the relief portion 41 from a rear of the first door 1. Through the arrangement of the corresponding shielding portion 5 on the first door 1 to shield the structural gap caused by the relief portion 41 after the second hinge 4 is mounted in place, an appearance effect is improved.

Specifically, the relief portion 41 open toward the body 101 may be directly observed from the rear after the second hinge 4 is mounted to the second mounting portion 11, and directly faces and is visible to the user when the first door 1 is opened. This affects the aesthetic appearance of the refrigeration appliance 1. Therefore, in this specific implementation, the shielding portion 5 is added to the first door 1, so that the notch cannot be directly observed from the rear of the first door 1, thereby optimizing the appearance effect of the refrigeration appliance 100.

For example, an adhesive may be added to the upper edge clamp of the first door 1 to create a rib to form the shielding portion 5.

In a specific implementation, still referring to FIGS. 1 to 4 and FIG. 15, the shielding portion 5 may include a first protruding rib 51 extending from the first side wall 12*a* of the groove 12 toward the second side wall 12*b*.

Specifically, the first protruding rib 51 may be located on a rear side of the first side wall 12*a* in the direction y and extend toward the second side wall 12*b*. Through the arrangement of the first protruding rib 51 behind the groove 12, the relief portion 41 arranged on the second hinge 4 may be shielded from the rear after the second hinge 4 is mounted to the second mounting portion 11.

In some embodiments, still referring to FIG. 3, the first flanging 42 located on an edge of the second hinge 4 facing the body 101 may not be flush with a rear wall of the upper edge clamp of the first door 1. In this case, openings of the first protruding rib 51 and the relief portion 41 facing the body 101 may be staggered in the direction x, and projections of the first protruding rib 51 and the first notch 411 in the direction y at least partially overlap.

Further, after the second hinge 4 is mounted to the second mounting portion 11, the first protruding rib 51 is located behind the first notch 411 in the direction y to shield the relief portion 41 from the rear. For example, the first protruding rib 51 may extend from the first side wall 12*a* to the second side wall 11*b*, to completely shield the first flanging 42 and the relief portion 41 located on the edge of the second hinge 4 facing the body 101 from the rear.

In some embodiments, the first flanging 42 located on the edge of the second hinge 4 facing the body 101 may be flush with the rear wall of the upper edge clamp of the first door 1. In this case, the openings of the first protruding rib 51 and the relief portion 41 facing the body 101 may be on a same straight line. Correspondingly, after the second hinge 4 is mounted in place, the first protruding rib 51 may directly fill an exposed part of the first notch 411 facing the rear.

In a specific implementation, the first protruding rib 51 may extend to contact an edge of the relief portion 41, to shield the relief portion 41 from the rear of the first door 1. In this way, the relief portion 41 and the first protruding rib 51 may approximately form a concave-convex structure, so that an appearance of the first door 1 remains substantially intact when viewed from the rear. When the first door 1 is opened, an area visible to the user has no obvious gap, thereby optimizing the overall appearance effect of the first door 1.

In a variation example, the first protruding rib 51 may extend to be close to the edge of the relief portion 41. In this way, the relief portion 41 may be shielded from the rear of the first door 1 to some extent. Specifically, the expression "be close to" may mean, for example, a non-zero gap may exist between the first protruding rib 51 and the relief portion 41 after the second hinge 4 is mounted to the second mounting portion 11. The gap falls within a tolerable error range. In an actual application, a specific value of the tolerable error range may be adjusted as required.

In a specific implementation, still referring to FIG. 2 to FIG. 4, FIG. 10, FIG. 14, and FIG. 15, the first door 1 may further include a second protruding rib 15 located above the wire harness hole 13 and protruding outward from a wall (for example, the first side wall 12*a*) where the wire harness hole 13 is located. The expression "outward" may be, for example, in the direction x.

Specifically, the second protruding rib 15 may serve as a baffle or an eave, and is arranged above the wire harness hole 13 in the direction z, to prevent foreign objects, liquids, and the like from entering the wire harness hole 13 and affecting electrical performance.

Further, in the direction z, after the second hinge cover 44 covers the second hinge 4, the second protruding rib 15 may be located below the second hinge cover 44. That is to say, the second hinge cover 44 may further shield the second protruding rib 15, so that a visible structure of the first door 1 is more concise. In this way, the appearance effect of the hinge mounting area of the first door 1 may be optimized.

In some embodiments, the second protruding rib 15 may be located outside a projection range of the second hinge cover 44 in the direction z. Through the arrangement of the second protruding rib 15 in the area that may be covered by the second hinge cover 44, the top appearance of the refrigeration appliance 100 may be optimized.

In a specific implementation, one of the second hinge 4 and the first door 1 may be provided with a stop portion 6, and the other of the second hinge 4 and the first door 1 may be provided with a fitting portion 7. The stop portion 6 is configured to be fitted to the fitting portion 7 to limit a maximum distance by which the second hinge 4 moves toward the first door 1 with the second door 2. This facilitates the assembly operation of the second door 2, so that the second door 2 may be assembled in place quickly.

FIG. 2, FIG. 3, FIG. 10, FIG. 16, and FIG. 18 exemplarily show that the first door 1 is provided with the stop portion 6 and the second hinge 4 is provided with the fitting portion 7. Specifically, during the movement of the second hinge 4 toward the first door 1 with the second door 2, projections of the stop portion 6 and the fitting portion 7 in the direction y at least partially overlap. In this case, when the second hinge 4 gradually approaches the first door 1 until the stop portion 6 and the fitting portion 7 abut against each other, the second hinge 4 and the second door 2 are prevented from further approaching the first door 1.

Through the fitting between the stop portion 6 and the fitting portion 7, rapid positioning of the second hinge 4 and the second mounting portion 11 may be achieved. For example, it is ensured that assembly holes on the second hinge 4 are aligned to assembly holes on the groove 12 of the second mounting portion 11 for subsequent mounting of fasteners. The assembly holes may be, for example, screw holes.

In a specific implementation, still referring to FIG. 2, FIG. 3, FIG. 10, FIG. 16, and FIG. 18, the stop portion 6 may include a stop rib 61 arranged on the first door 1 and located in front of the wire harness hole 13. Correspondingly, the fitting portion 7 may include an extension 71 extending outward from the second hinge 4, and projections of the extension 71 and the stop rib 61 in the thickness direction of the first door 1 (for example, the direction y) at least partially overlap.

In some implementations, the first flanging 42 forming a boundary of the first notch 411 away from the body 101 may be bent outward (for example, may be bent away from the first portion 43 and/or the connection accommodating portion 45 in the direction x) to form the extension 71.

In some embodiments, the stop rib 61 may be located in front of the wire harness hole 13 and protrude outward from the wall (for example, the first side wall 12*a*) where the wire harness hole 13 is located. The expression "outward" may be, for example, in the direction x.

In this way, the extent to which the second hinge 4 is allowed to retreat backward may be reliably limited, thereby preventing the second hinge 4 from moving backward excessively and impacting the first door 1 or even damaging the body 101. Further, the stop rib 61 arranged in front of the wire harness hole 13 may stop the non-relief portion of the second hinge 4 in front of the wire harness hole 13, thereby preventing the second hinge 4 from being excessively close to the first door 1 and contacting the part of the first wire harness 14 extending out through the wire harness hole 13.

In this implementation, during assembly of the second door 2, the design of the relief portion 41 prevents a transversely extended wire harness in the hinge area of the first door 1 from hindering the assembly of the second door 2 with the second hinge 4. Specifically, in this implementation, the mounting structure of the second hinge 4 is improved. The relief portion 41 is arranged on the second hinge 4 to prevent the extended wire harness of the first door 1 from hindering the assembly of the second door 2. This may facilitate the assembly operation of the refrigeration appliance 100, so that the refrigeration appliance 100 in this implementation may employ a production process of first assembling the first door 1 and then assembling the second door 2 during online production of a door-on-door product with wire harness connection. The door assembly manner is more in line with the ergonomics. Further, the relief portion 41 is integrated into the second hinge 4, so that the first door 1 and the second door 2 may retain the original structures, and more space on the door may be reserved for other structures, thereby achieving a more compact and proper layout for the structures on the door.

In a typical application scenario, the assembly process of the refrigeration appliance 100 in this embodiment may include the following steps. First, the body 101 is provided. Then, referring to FIG. 5 and FIG. 9, before the DonD system is mounted, the third hinge 103 and a first shaft sleeve 104 may be mounted to a right side of a crossbeam of the body 101. The third hinge 103 may be connected to the body 101 through screws.

Figure 6:
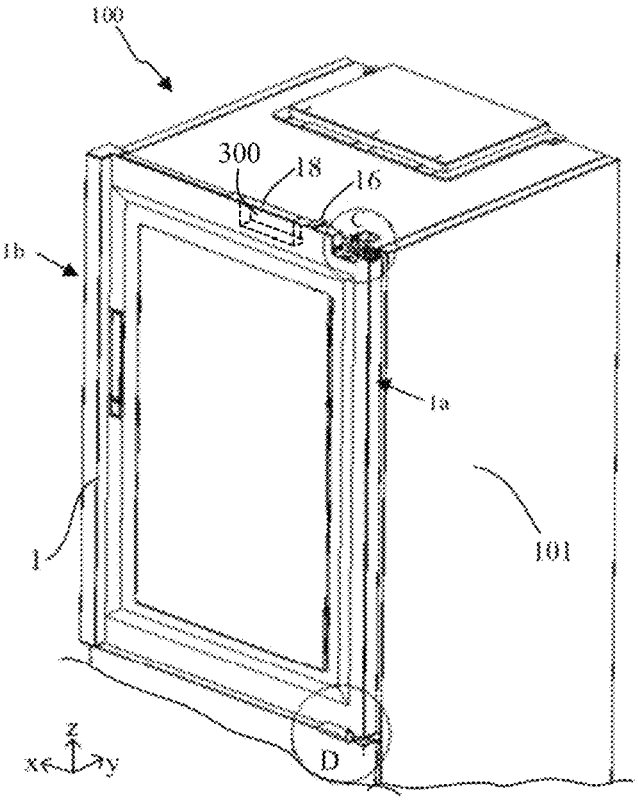
Figure 11:
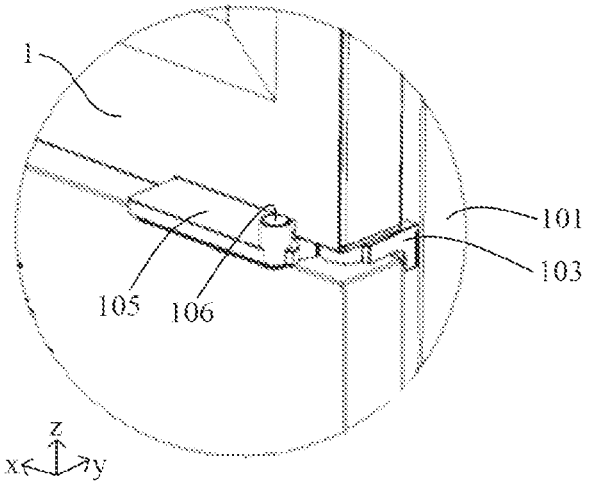
FIG. 11 is a partial, enlarged, perspective view of region D shown in FIG. 6.

Next, referring to FIG. 6, FIG. 10, and FIG. 11, according to the production process, the first door 1 is first mounted and then the second door 2 is mounted. The fourth hinge 105 is first mounted to the bottom of the first door 1, and then the assembled first door 1 is mounted to the third hinge 103. Then, the first hinge 3 is mounted. For example, the hinge shaft of the first hinge 3 is inserted into the first shaft hole 32 located in the first mounting portion 10 (as shown in FIG. 1 to FIG. 4), and remaining parts of the first hinge 3 are fixed to the body 101.

Figure 7:
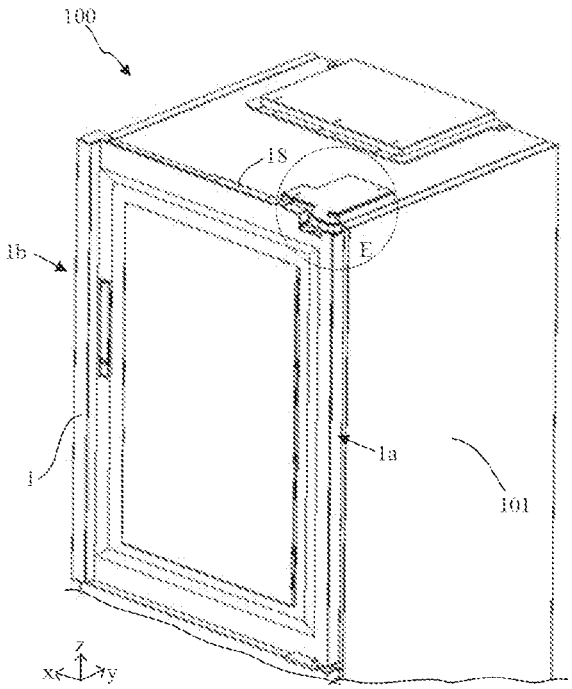

Referring to FIG. 7 and FIG. 12, after the first door 1 is mounted, the first hinge cover 31 is mounted to cover the first hinge 3. In this step, the first detector 109 may be arranged at a position on the top of the body 101 near the first hinge 3. The first hinge cover 31 is adapted to cover the first hinge 3 and the first detector 109. In this case, a transverse wire outlet hole (for example, the wire harness hole 13) exists at a position on the upper edge clamp of the first door 1 near a rotation shaft (also referred to as a hinge shaft) of the first hinge 3, and a wire harness terminal (for example, a part of the first wire harness 14 and the first electrical connector 141) that connected to the second door 2 extends out from the inside and flips and is fixed to an upper part of the first door 1 by using an adhesive tape. The first wire harness 14 further leads out the third wire harness 19 from the inside the first door 1. The third wire harness is adapted to be electrically connected to the second detector 18 located in the first door 1.

Figure 20:
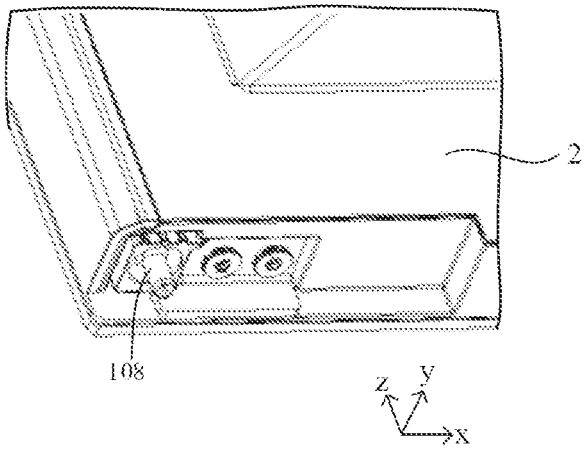
FIG. 20 is a partial, enlarged, perspective view of region I shown in FIG. 17.

Next, the second door 2 is mounted, as shown in FIG. 17 to FIG. 20. Before the second door 2 is assembled onto the body 101, a DonD hinge system needs to be mounted. FIG. 17 is a schematic pre-assembled diagram of the second door 2 and the second hinge 4 according to an embodiment of the present invention. FIG. 18 is a partial enlarged view of a region H in FIG. 17. FIG. 19 is a partial enlarged view of the second door 2 in the region H in FIG. 17. FIG. 20 is a partial enlarged view of a region I in FIG. 17.

Specifically, an automatic door opening hinge 108 may be mounted to a lower part of the second door 2. A circular shaft (that is, the hinge shaft 47) of the second hinge 4 shown in FIG. 16 is inserted into the shaft sleeve (not shown in the figure) and is fixed in the second shaft hole 231 of an upper edge clamp of the second door 2 shown in FIG. 19, to obtain a pre-assembled body shown in FIG. 17 and FIG. 18. In this case, the second hinge 4 may rotate and move relative to the second door 2. However, when the door body of the second door 2 is mounted to the body 101 with the first door 1, the second hinge 4 and the second door 2 form a pre-assembled body and move together. The second wire harness 21 on the second door 2 may partially extend out through the hinge shaft 47, and may be placed on the connection accommodating portion 45, as shown in FIG. 18.

Figure 8:
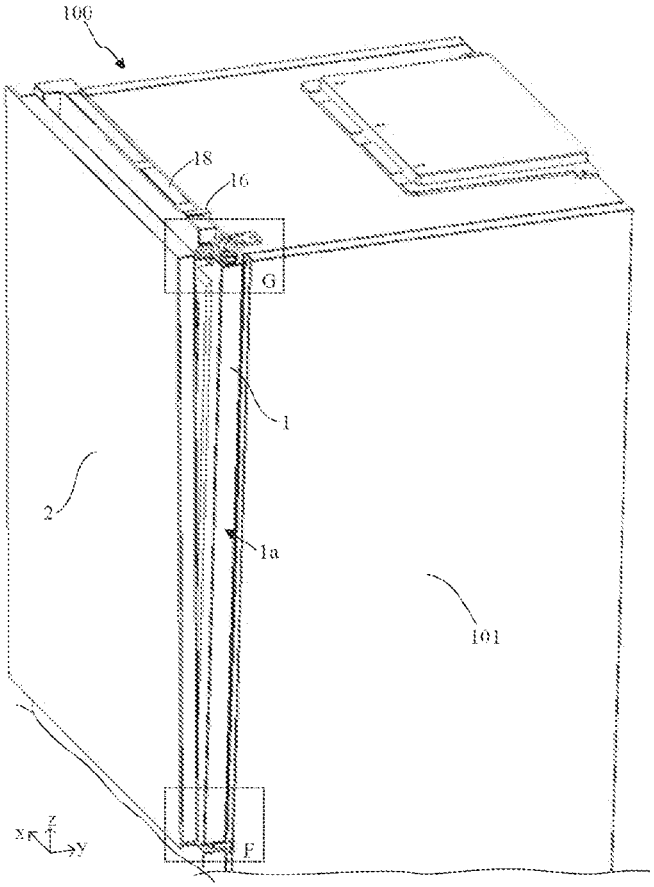
Figure 9:
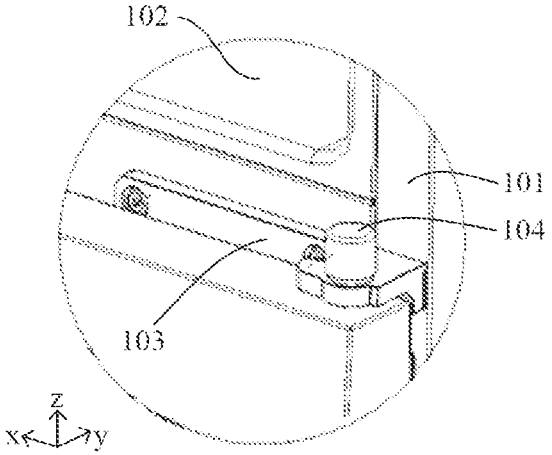
FIG. 9 is a partial, enlarged, perspective view of region B shown in FIG. 5.

Referring to FIG. 8, FIG. 13, and FIG. 15, during mounting of the second door 2 on the production line, the pre-assembled body of the second door 2 shown in FIG. 17 is transported to the line. The fourth hinge 105 is mounted first. Specifically, a rotation shaft of the automatic door opening hinge 108 at the bottom of the second door 2 is aligned and assembled to a fourth shaft hole 106 of the fourth hinge 105 at the bottom of the first door 1, as shown in FIG. 13. FIG. 8 and FIG. 14 do not show the first hinge cover 31.

Then, the upper part of the second door 2 is pushed from the outside to the inside. In this case, a latch 22 in the middle of the handle side of the second door 2 locks the first door 1, and the second hinge 4 at a top of the hinge side is pushed into the mounting position of the first door 1.

In this process, through the cooperation of the upper edge clamp of the first door 1 and the relief portion 41 of the second hinge 2, the first wire harness 14 hindering the movement of the second door 2 and the second hinge 4 that are pre-assembled is effectively avoided.

Specifically, the relief portion 41 open toward at least the body 101 may prevent interference between the second hinge 4 and the extended first wire harness 14 of the first door 1 at the wire harness hole 13 during the pushing of the second door 2.

Likewise, during disassembly of the body 101 through pulling of the upper part of the second door 2 away from the body 101, the design of the relief portion 41 prevents interference between the first wire harness 14 and the transversely extended wire on the upper edge clamp of the first door 1 extending out.

Referring to FIG. 2 and FIG. 3, as the second hinge 4 reaches the mounting position, the notch formed by the relief portion 41 of the second hinge 4 is assembled is assembled in place through the transverse wire outlet area of the first door 1. In addition, the notch resulting from the relief portion 41 on the second hinge 4 is supplemented by the rib protruding from the upper edge clamp of the first door 1, thereby improving the appearance effect. Specifically, the shielding portion 5 is arranged at a position on the upper edge clamp of the first door 1 corresponding to the relief portion 41, to cover the notch generated after the second hinge 4 is mounted in place, thereby improving the appearance effect. Finally, the second hinge cover 44 and the first hinge cover 31 are mounted to obtain the structure shown in FIG. 1. FIG. 1 to FIG. 3 do not show the first hinge 3 and the first hinge cover 31.

Although the specific implementations have been described above, these implementations are not intended to limit the scope of the present disclosure, even if only a single implementation is described with respect to specific features. The feature examples provided in the present disclosure are intended for illustration but not limitation, unless otherwise stated. During specific implementation, the technical features of one or more dependent claims may be combined with the technical features of the independent claims, and the technical features from the corresponding independent claims may be combined in any proper way, not only through the specific combination listed in the claims.

Although the present invention is disclosed as above, the present invention is not limited thereto. A person skilled in the art may make various changes and modifications without departing from the spirit and the scope of the present invention. Therefore, the protection scope of the present invention should be subject to the scope defined by the claims.

The invention claimed is:

1. A refrigeration appliance, comprising:

a body configured to define at least one storage compartment;

a first hinge;

a first door connected to said body through said first hinge, wherein said first door is configured to open to enable access and close to inhibit access to one of said at least one storage compartment;

a second hinge;

a second door connected to a front of said first door through said second hinge;

a first wire harness disposed in said first door, said first wire harness having a first electrical connector;

a second wire harness disposed in said second door, said second wire harness having a second electrical connector; and a connection accommodating portion, wherein said first electrical connector and said second electrical connector are located at said connection accommodating portion, wherein said first electrical connector and said second electrical connector are coupled at said connection accommodating portion to electrically connect said first wire harness and said second wire harness, and said connection accommodating portion is disposed on said second hinge;

wherein said second hinge includes a first portion configured to be fixed to said first door and a separator wall arranged between said connection accommodating portion and said first portion.

2. The refrigeration appliance according to claim 1, wherein said connection accommodating portion is at least partially disposed outside a projection range of said first door in a height direction of the refrigeration appliance.

3. The refrigeration appliance according to claim 1, wherein said connection accommodating portion is at least partially disposed within a projection range of said second door in a height direction of the refrigeration appliance.

4. The refrigeration appliance according to claim 2, wherein said second door has a receiving portion configured to receive a part of said connection accommodating portion disposed outside the projection range of said first door in the height direction of the refrigeration appliance.

5. The refrigeration appliance according to claim 1, further comprising a top unit disposed at a top of said first door, wherein said top unit is configured to detect, operate, or control the refrigeration appliance; and wherein said first door has a first side and a second side opposite to each other in a width direction, said first hinge is disposed on said first side, and said top unit is closer to said first side than to said second side.

6. The refrigeration appliance according to claim 1, wherein:

said first door includes:

a first mounting portion configured to mount said first hinge;

a second mounting portion configured to mount said second hinge; and a wire harness hole formed therein and opens toward said second mounting portion, wherein said wire harness hole is configured for said first wire harness disposed inside said first door to extend to or be electrically connected to outside of said first door; and said second hinge further has a relief portion at least partially open toward said body for avoiding a part of said first wire harness extending out through said wire harness hole.

7. The refrigeration appliance according to claim 6, wherein during a movement of said second hinge with said second door away from or toward said first door, said relief portion is adapted to prevent interference between said second hinge and said part of said first wire harness extending out through said wire harness hole, and/or said relief portion is adapted to enable direct or indirect communication between said connection accommodating portion and said wire harness hole.

8. The refrigeration appliance according to claim 6, wherein an edge of said second hinge has a first flanging extending upward, and said relief portion has a first notch provided on said first flanging, wherein said first notch is at least partially open toward said body.

9. The refrigeration appliance according to claim 6, further comprising a shielding portion disposed on said first door, wherein said shielding portion is configured to at least shield said relief portion from a rear of said first door.

10. The refrigeration appliance according to claim 9, wherein:

said second mounting portion has a groove formed therein and recessed downward from said first mounting portion; and said shielding portion has a first protruding rib, and said first protruding rib extends from a first side wall of said groove away from said first mounting portion toward a second side wall close to said first mounting portion.

11. The refrigeration appliance according to claim 10, wherein said first protruding rib extends to contact or be close to an edge of said relief portion, to shield said relief portion from said rear of said first door.

12. The refrigeration appliance according to claim 6, wherein said first door further has a second protruding rib located above said wire harness hole and protruding outward from a wall where said wire harness hole is disposed.

13. The refrigeration appliance according to claim 12, further comprising a second hinge cover configured to cover said second hinge, wherein said second protruding rib is disposed below said second hinge cover, and/or said second protruding rib is disposed in a projection range of said second hinge cover in a height direction of the refrigeration appliance.

14. The refrigeration appliance according to claim 6, wherein one of said second hinge and said first door has a stop portion, and the other of said second hinge and said first door has a fitting portion, wherein said stop portion is configured to be fitted to said fitting portion to limit a maximum distance by which said second hinge moves toward said first door with said second door.

15. The refrigeration appliance according to claim 6, wherein said second mounting portion has a groove formed therein and recessed downward from said first mounting portion, wherein said wire harness hole is disposed in one of a pair of opposite side walls of said groove in a width direction of said first door.

16. A refrigeration appliance, comprising:

a body configured to define at least one storage compartment;

a first hinge;

a first door connected to said body through said first hinge, wherein said first door is configured to open to enable access and close to inhibit access to one of said at least one storage compartment;

a second hinge;

a second door connected to a front of said first door through said second hinge;

a first wire harness disposed in said first door;

a second wire harness disposed in said second door;

a connection accommodating portion, wherein said first wire harness disposed in said first door and said second wire harness disposed in said second door are electrically connected to each other in said connection accommodating portion, and said connection accommodating portion is disposed on said second hinge;

said first door including:

a first mounting portion configured for mounting said first hinge;

a second mounting portion configured for mounting said second hinge; and a wire harness hole formed therein and opening toward said second mounting portion, wherein said wire harness hole is configured for said first wire harness disposed inside said first door to extend to or be electrically connected to outside of said first door; and said second hinge further having a relief portion at least partially open toward said body for avoiding a part of said first wire harness extending out through said wire harness hole; and said second hinge further having a first portion configured for being fixed to said second mounting portion, said relief portion having a second notch, and said second notch being formed by recessing an edge of said first portion inward.

* * * * *